US012601171B2

(12) United States Patent
Schieberl

(10) Patent No.: US 12,601,171 B2
(45) Date of Patent: Apr. 14, 2026

(54) PLASTIC BUILDING BLOCKS

(71) Applicant: Daniel Schieberl, Santa Rosa, CA (US)

(72) Inventor: Daniel Schieberl, Santa Rosa, CA (US)

(73) Assignee: ECO Snap Blocks, Inc, Santa Rosa, CA (US)

( * ) Notice: Subject to any disclaimer, the term of this patent is extended or adjusted under 35 U.S.C. 154(b) by 307 days.

(21) Appl. No.: 18/605,659

(22) Filed: Mar. 14, 2024

(65) Prior Publication Data

US 2024/0218658 A1 Jul. 4, 2024

Related U.S. Application Data

(63) Continuation-in-part of application No. 17/854,644, filed on Jun. 30, 2022, now Pat. No. 12,139,907.

(51) Int. Cl.
*E04B 2/18* (2006.01)
*E04B 2/02* (2006.01)

(52) U.S. Cl.
CPC ..... *E04B 2/18* (2013.01); *E04B 2002/0206* (2013.01); *E04B 2103/04* (2013.01)

(58) Field of Classification Search
CPC ..... E04B 2/18; E04B 2002/0213; E04B 2002/0243; E04B 2002/0263; E04B 2002/0206; E04B 2103/04; E04B 2/14; E04B 2/20; E04B 2/24; E04C 1/397
See application file for complete search history.

(56) References Cited

U.S. PATENT DOCUMENTS 1,418,168 A * 5/1922 Preston ..... E04B 2/14 52/591.5
5,024,035 A * 6/1991 Hanson ..... E04B 2/18 52/591.1
5,107,653 A * 4/1992 Lewis ..... E04B 2/22 52/574
5,457,926 A * 10/1995 Jensen ..... E04B 2/18 52/309.4
6,050,044 A * 4/2000 McIntosh ..... A63H 33/082 446/124
8,495,850 B1 * 7/2013 Lin ..... A63H 33/086 446/124

(Continued)

FOREIGN PATENT DOCUMENTS

AU 2020230258 A1 * 4/2021 ..... E04C 1/397
EP 3456894 A1 * 3/2019 ..... E04C 1/397

(Continued)

*Primary Examiner* — Rodney Mintz
(74) *Attorney, Agent, or Firm* — My Patent Guys; Christopher Pilling

(57) ABSTRACT

The present invention encompasses an eco-friendly plastic building block system for constructing a variety of structures. Each block features an interlocking design with male positioning elements for seamless assembly into continuous vertical walls. Embedded conduits within the blocks allow for easy integration of electrical and plumbing systems. Manufactured from plastic, or recycled plastic, these blocks offer a sustainable building solution, combining environmental benefits with practical utility. The design incorporates vertical ridges for added structural support and alignment, while a mostly hollow interior enhances insulation properties. Recess may be provided to assist with cutouts, outlets, or electrical boxes.

14 Claims, 8 Drawing Sheets

(56) References Cited

U.S. PATENT DOCUMENTS 9,528,263 B2 * 12/2016 Lightfoot ..... E04B 2/02
10,787,810 B2 * 9/2020 Bergollo ..... E04B 2/18
11,459,161 B2 * 10/2022 Seichei ..... B65D 21/0204
11,959,274 B2 * 4/2024 Bowers ..... B29B 17/04
12,037,786 B2 * 7/2024 Frederico ..... E04B 2/18
12,139,907 B2 * 11/2024 Schieberl ..... E04B 2/18
12,276,102 B2 * 4/2025 Bell ..... E04B 2/46
12,311,281 B2 * 5/2025 Patel ..... E04B 2/18
D1,096,155 S * 10/2025 Seichei ..... B65D 21/0204
D9/560
12,540,470 B2 * 2/2026 Mohebbi ..... E04B 2/18
2005/0102950 A1 * 5/2005 Knudson ..... E02D 29/025
52/596
2005/0129468 A1 * 6/2005 Knudson ..... E02D 29/025
405/262
2013/0205705 A1 * 8/2013 Bilka ..... E04B 2/08
52/745.1
2016/0123004 A1 * 5/2016 Lightfoot ..... E04B 2/02
52/286
2016/0340898 A1 * 11/2016 Lightfoot ..... E04B 2/10
2018/0347187 A1 * 12/2018 Parks ..... E04C 1/41
2018/0347188 A1 * 12/2018 Parks ..... E04B 2/18
2019/0211548 A1 * 7/2019 Thurston ..... E04C 1/41
2019/0383004 A1 * 12/2019 Waters ..... E04B 2/18
2020/0087050 A1 * 3/2020 Seichei ..... E04B 2/18
2020/0217066 A1 * 7/2020 Bergollo ..... E04B 2/08
2022/0064941 A1 * 3/2022 Bowers ..... E04B 2/18
2022/0136238 A1 * 5/2022 Felton ..... E04B 2/18
52/596
2022/0288502 A1 * 9/2022 Patel ..... A63H 33/084
2022/0364358 A1 * 11/2022 Simpson ..... E04C 1/00
2023/0160199 A1 * 5/2023 Bowers ..... B29B 17/0026
52/300
2023/0287679 A1 * 9/2023 Felton ..... E04B 2/08
2024/0003132 A1 * 1/2024 Schieberl ..... E04C 1/397
2024/0018776 A1 * 1/2024 Bell ..... E04B 2/46
2024/0084586 A1 * 3/2024 Frederico ..... E04B 2/18
2024/0125116 A1 * 4/2024 Mohebbi ..... E04B 2/18
2024/0247483 A1 * 7/2024 Plesnik ..... E04B 2/18

FOREIGN PATENT DOCUMENTS

WO WO-2012056394 A1 * 5/2012 ..... E04C 1/40
WO WO-2019227181 A1 * 12/2019 ..... E04B 2/18

* cited by examiner

PLASTIC BUILDING BLOCKS

CROSS-REFERENCE TO RELATED APPLICATIONS

The present invention is a continuation-in-part application to U.S. Nonprovisional application Ser. No. 17/854,644, filed Jun. 30, 2022, which is hereby incorporated in its entirety, at least by reference.

BACKGROUND OF THE INVENTION

1. Field of the Invention

The present invention relates generally to building materials and more particularly to plastic building blocks.

2. Description of Related Art

With the rising costs of building materials, the present invention offers a solution, providing easy to assemble, inexpensive modular blocks composed of sustainable materials that combine to form sturdy, dependable walls for the use of building structures.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present disclosure to provide a sustainable building block constructed of plastic. It is another object of the present invention to provide building blocks constructed of plastic, and particularly recycled plastic. It is another object of the present invention to provide an interlocking building block configured to interlock to an adjacent block in a vertical position. It is yet another object of the invention to provide a sturdy block that can form the exterior and interior surfaces of the building. It is yet another object of the invention to provide pathways for electrical and plumbing connections.

In order to do so, a plastic building block is provided comprising a rectangular body with a top side, a bottom side, left side, right side, front side, and rear side, a plurality of male positioning elements located at the top side configured to facilitate interlocking with an adjacent vertical plastic building block; at least one conduit integrated within the block for routing electrical wires, plumbing, or other utilities; wherein the rectangular body includes a rectangular body wall extending upwardly from the bottom side, the rectangular body wall configured to snugly fit with the plurality of male positioning elements of the adjacent vertical plastic building block, such that the plurality of male positioning elements abut the rectangular body wall, ensuring stable stacking and alignment of the interconnected blocks; and, wherein the interconnected blocks are configured to form the exterior and interior walls of a building structure for human occupancy.

In one embodiment, the rectangular body being divided into two identical sections that combine to form a unitary structure. In another embodiment, the plurality of male positioning elements border each section of the two identical sections. In yet another embodiment, the at least one conduit is two circular conduits, each circular conduit positioned at the center of each identical section. In one embodiment, the plurality of male positioning elements are configured in L-shaped and T-shaped sections, the T-shaped sections extending from at least one conduit, and the L-shaped sections are positioned approximate to the border of each section of the two identical sections. In one embodiment, a plurality of vertical ridges are provided and positioned on the left, right, front, and rear sides. In one embodiment, the rectangular body is primarily hollow. In another embodiment, the plastic building block is made from recycled plastic. In one embodiment, the rectangular body is square. In another embodiment, a recess is provided and positioned on one side of the plastic building block. In yet another embodiment, the recess is configured for use as an electrical box for electrical wiring or as a cutout for plumbing and other utilities. In one embodiment, additional conduits are provided of smaller size in relation to the at least one conduit, wherein the additional conduits are configured for electrical, data, phone wires, or similar utilities. In one embodiment, the plurality of male positioning elements extend approximately 5% of the total height of the plastic building block, and the plurality of male positioning elements protruding from a top surface on the top side of the plastic building block. In one embodiment, the interconnected blocks are joined using bonding agents, epoxy, mortar, glue, or similar substances for permanent construction. In one embodiment, the rectangular body is approximately 12 inches in length, 6 inches in height, and selectable widths of either 12 inches or 6 inches.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide plastic building blocks.

It is to be understood that the terminology used herein is for the purpose of describing particular embodiments only and is not intended to be limiting. The terms "a" or "an," as used herein, are defined to mean "at least one." The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanently. The term "providing" is defined herein in its broadest sense, e.g., bringing/coming into physical existence, making available, and/or supplying to someone or something, in whole or in multiple parts at once or over a period of time. As used herein, the terms "about," "generally," or "approximately," apply to all numeric values, whether or not explicitly indicated. These terms generally refer to a range of numbers that one of skill in the art would consider near the stated amount by about 0%, 5%, or 10%, including increments therein. In many instances these terms may include numbers that are rounded to the nearest significant figure.

Figure 1:
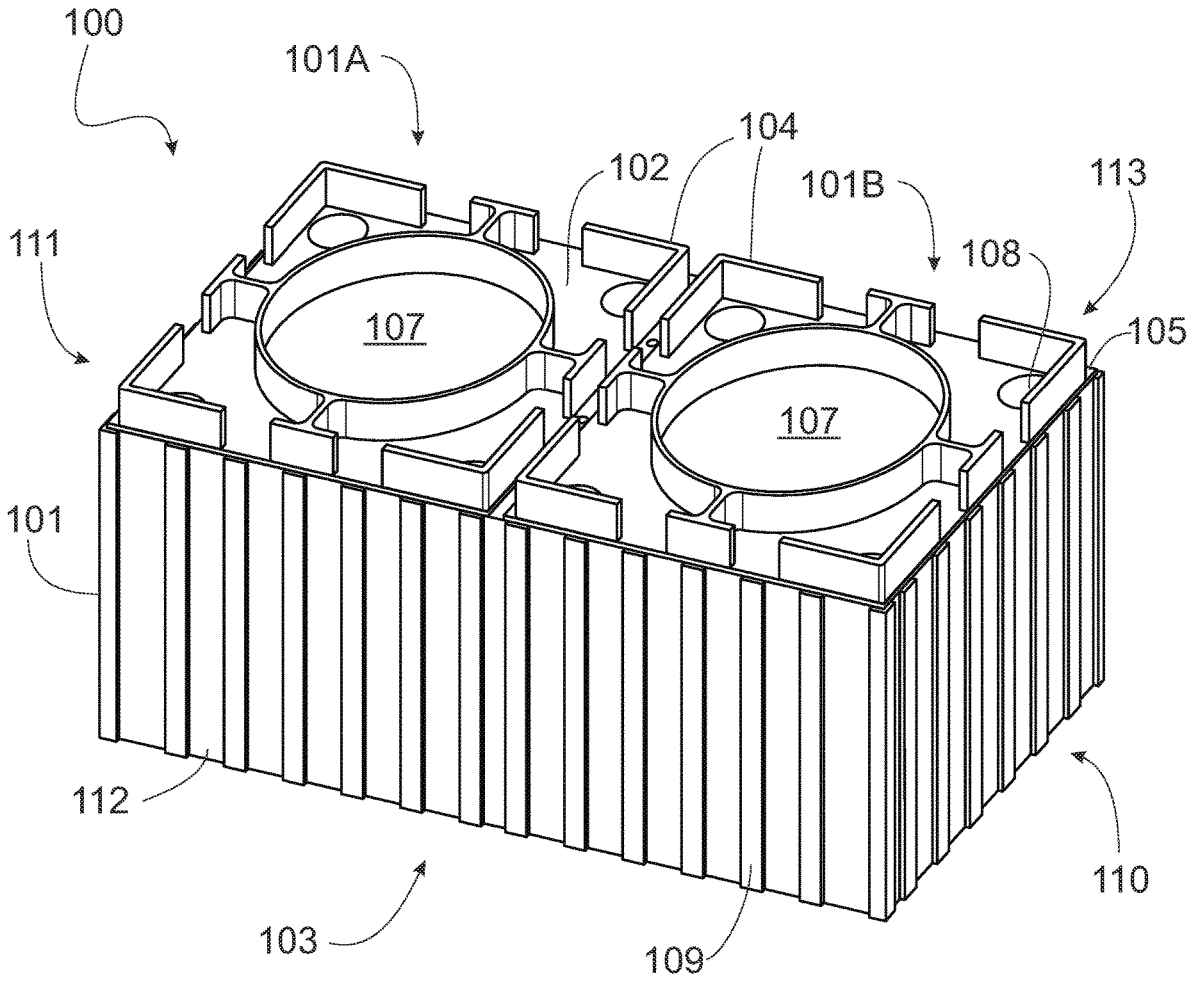
FIG. 1 is a perspective view of a plastic building block according to an embodiment of the present invention.
Figure 2:
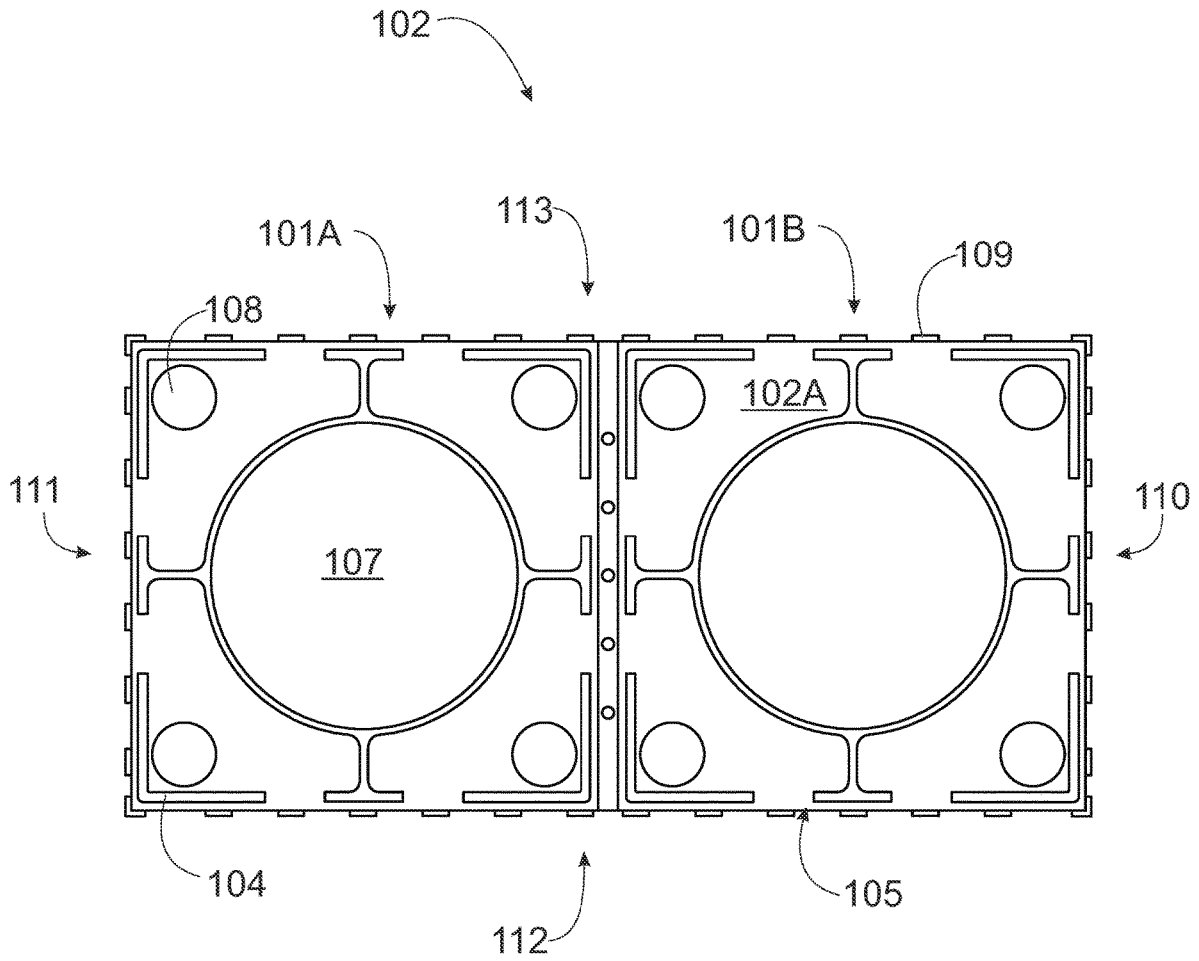
FIG. 2 is a top view of the plastic building block according to an embodiment of the present invention.
Figure 3:
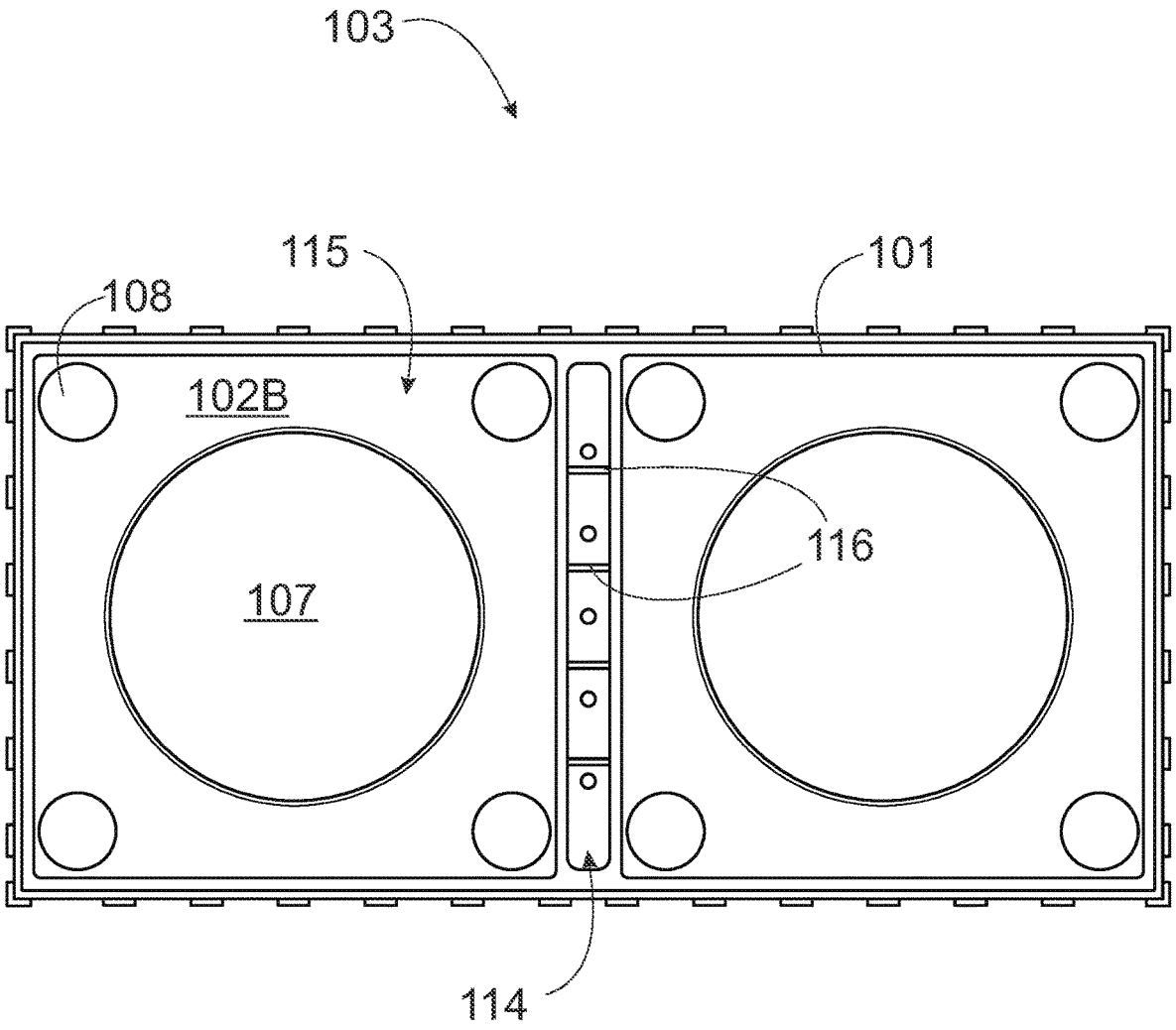
FIG. 3 is a bottom view of the plastic building block according to an embodiment of the present invention.
Figure 4:
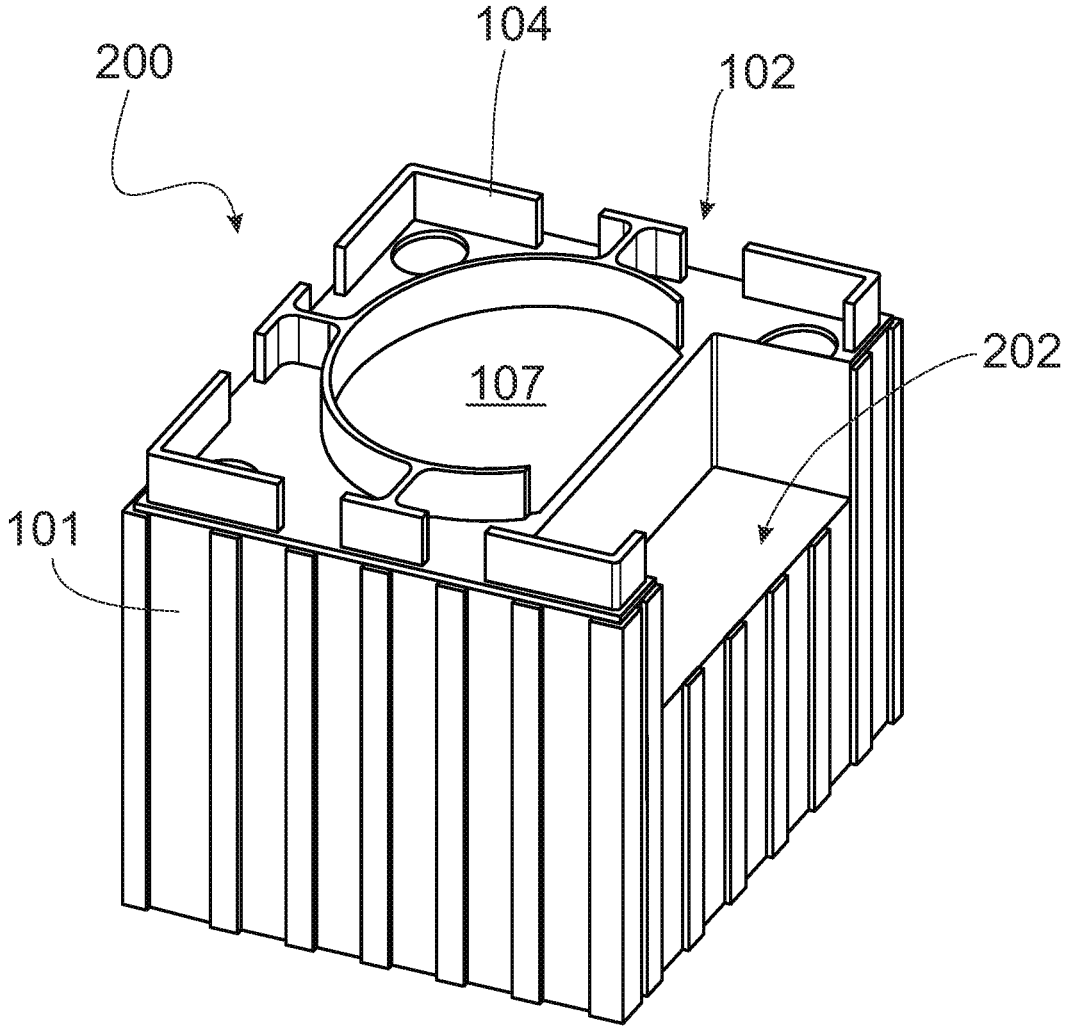
FIG. 4 is a perspective view of an alternative plastic building block according to an embodiment of the present invention.
Figure 5:
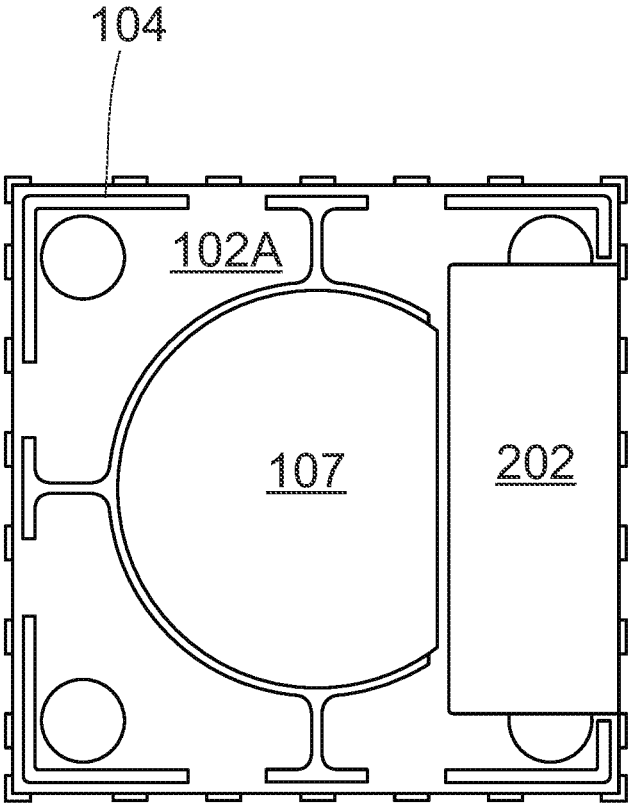
FIG. 5 is a top view of the alternative plastic building block according to an embodiment of the present invention.
Figure 6:
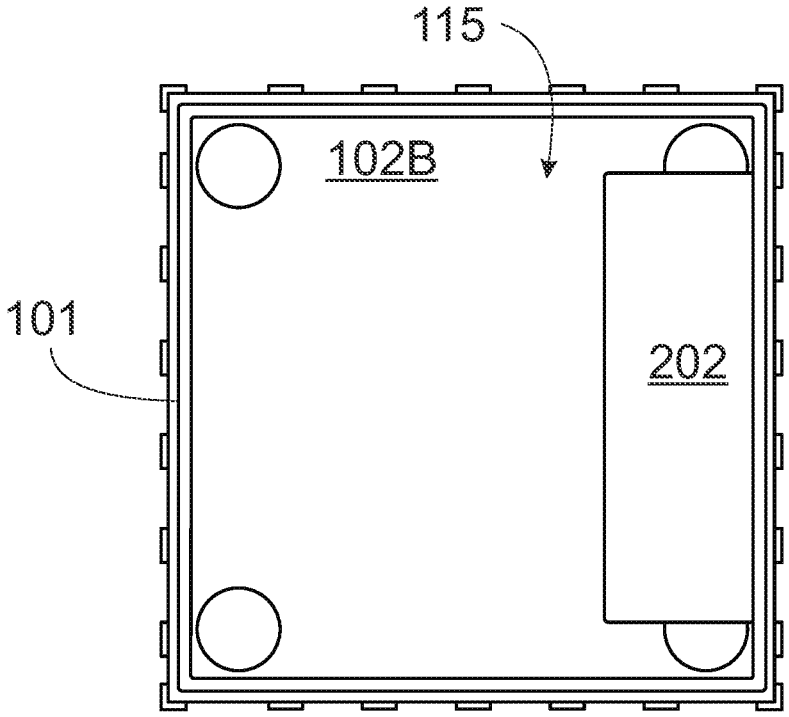
FIG. 6 is a bottom view of the alternative plastic building block according to an embodiment of the present invention.
Figure 7:
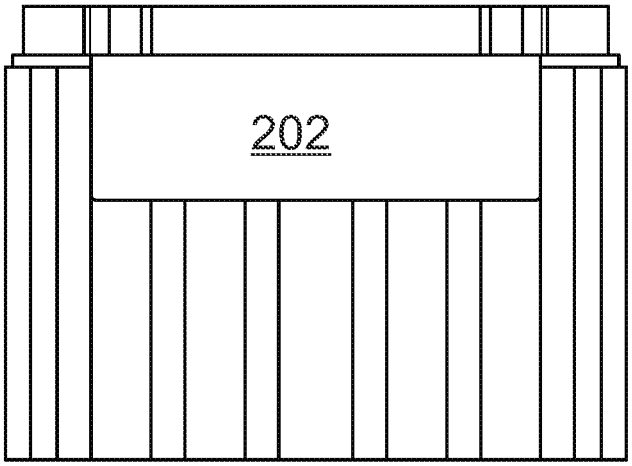
FIG. 7 is a left side view of the alternative plastic building block according to an embodiment of the present invention.

Referring now to the accompanying FIGS. 1-3, a plastic building block 100 is illustrated. In one embodiment, the plastic building block 100 comprises a rectangular body 101 having a top side 102, a bottom side 103, a left side 110, a right side 111, and a front and rear side 112 and 113 respectively. In some embodiments, each plastic building block consists of two sections 101A and 101B, however both sections combine to form one integral unit defined by rectangular body 101. Advantageously, each plastic building block 100 is configured to join and interlock with an adjacent vertical block to form a continuous wall of a structure. The adjacent block is configured to be left, right, above, or below the block, i.e. the plastic building block 100 is configured to attach to an adjacent block at a planer location to the first block, either horizontal and/or vertical. In one embodiment, male positioning elements 104 are shaped as perimeter guides, which border and protrude from the top surface 102A of each section (101A/101B) of block. More specifically, the male positioning elements 104 protrude from the top surface 102A of each body section 101A/101B at a perimeter location adjacent to the perimeter edge of the body 101, such that there is a small perimeter edge 105 exposed enabling the blocks to stack seamlessly (best seen in FIG. 8).

In some embodiments, the male positioning elements 104 follow the perimeter of each section, and protrude approximately 5% of the total height of the block. In some embodiments, the male positioning elements 104 are in sections, for example, each corner includes a protruding L-section, and four T-sections extend from the circular conduit towards each side of the block. The male positioning elements are generally symmetrical, and featured on both sections of the top side of the plastic building block.

In some embodiments, the plastic building block 100 comprises at least one conduit 107 enabling electrical wires and/or plumbing to be fed through one or more connected vertical blocks. In some embodiments, the conduit 107 is circular in nature, and approximately as large in diameter as the section it occupies. In some embodiments, additional conduits 108, smaller in size are provided for dedicated electrical, data, phone or similar wires to be fed through the blocks. Further, once installed, holes, cutouts etc. may be drilled, cut, or fabricated such that the electrical and/or plumbing connections may be accessed. Likewise, any traditional building techniques, including not limited to, insulation, drywall, switches, outlets, painting, etc. may be used with the blocks of the present invention. However, due to the dense plastic construction of the blocks, the blocks naturally provide effective insulation and are configured to be used and provide the exterior and interior of a building structure.

In some embodiments, the plastic building block 100 includes a plurality of vertical ridges 109 spaced and positioned on the left side 110, the right side 111, the front side 112, and rear side 113, wherein the ridges providing support to the structure of the plastic building block as well as providing a visual aid in properly lining up connecting blocks. It should be noted that, the plastic building block 100 is mostly hollow, the top surface having a top side 102 and a bottom side 102B, wherein the bottom side 102B defines a hollow portion 115 (best seen in FIG. 3) which is the majority of the inner volume of each section of the plastic building block.

Best seen in FIG. 3, the lower edge of the rectangular body 101 is seen which defines the bottom surface of the plastic building block 103 and is critical for the connection and joining of the blocks when in a stacked arrangement. In one embodiment, the male positioning elements 104 (as seen in FIGS. 1 and 2) are configured to snugly fit within the bottom portion of an adjacent vertical block such that the male positioning elements 104 abut the rectangular body wall, indicated as 101 in FIG. 3. In some embodiments, the bottom section of the plastic building block includes a center element 114 having sections 116 which spans from the front side to the rear side. The center element 114 provides support to the overall structure of the rectangular body of the plastic building block, and the ridges or sections 116 provide support for the center element 114. In some embodiments, the center element aids in the securement via the male position elements 104, more particularly the male position elements in the center of the plastic building block abut the sides of the center element in a similar fashion as described above with the rectangular body wall.

Referring now to FIGS. 4-7, an alternative plastic building block 200 is illustrated. In one embodiment, the alternative plastic building block 200 comprises a rectangular body having a top side, a bottom side, a left side, a right side, and a front and rear side similarly discussed for the first embodiment of the plastic building block. The main points or areas of differentiation between the first embodiment of the plastic building block 100 and the alternative plastic building block 200 is that the rectangular body is a square, which is generally half the length as the first embodiment in width. In some embodiments, a recess 202 is provided on one side of the block 200. Advantageously, the recess may act as an outlet gang or box for electrical wiring, or may be used as a cutout for any plumbing, electrical, or other wiring or conduits. Otherwise, the function and adjoining of stacked blocks is similar to previously discussed, via male positioning elements 104 and body wall 101. In this embodiment, the block is mostly hollow as well wherein the hollow portion 115 is defined by the area between the body wall 101 and the bottom side 102B of the top surface 102A.

Figure 8:
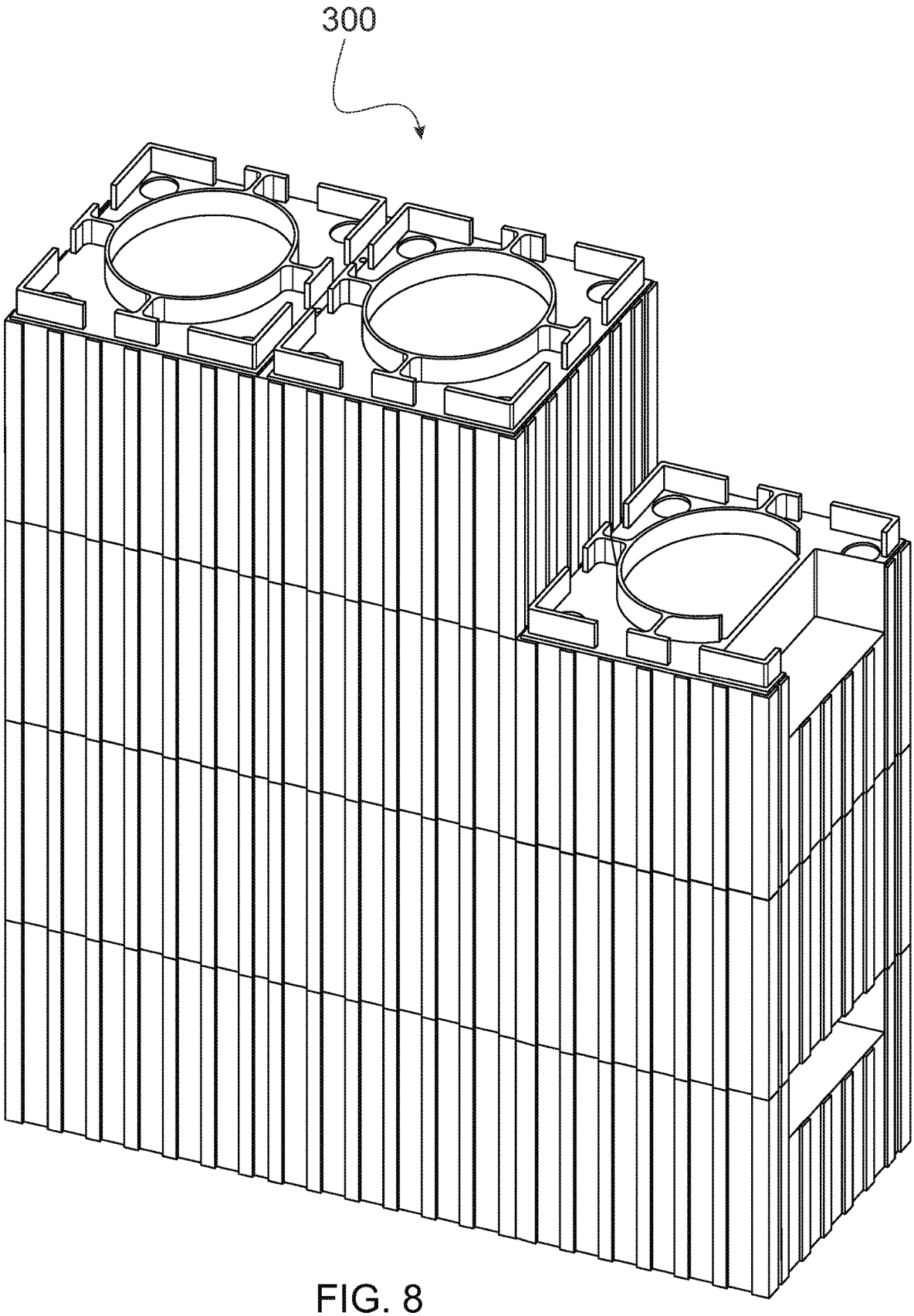
FIG. 8 is an example of a plurality of plastic building blocks and alternative plastic building blocks stacked during use according to an embodiment of the present invention.

Best seen in FIG. 8, the plastic building blocks are configured to lock and adjoin in a lego-like fashion to create a seamless wall 300, with male positioning elements ensuring proper alignment. Although this may be adequate, if a permanent structure is desired, substances may be used, such as bonding agents, epoxy, mortar, glues, etc. to permanently join adjacent blocks to each other.

Although the size may vary, in one embodiment, the plastic rectangular block is approximately 12" in length, 6" in height, and 12" or 6" in width, depending on the version. In other embodiments, different shaped blocks may be used to complete the building structure formation.

The plastic building blocks of the present invention may be used for the construction of any building or structure, including single story homes, multiple family units, multistory homes and structures, offices, commercial spaces, bridges, walls, sporting complexes, or other building structures. Further, they can be combined or integrated with other stick-built, brick, concrete, or modular structures.

In some embodiments, the plastic building block is entirely constructed from recycled plastic. In one embodiment, each block is formed via injection molding. In another embodiment, each block is formed via casting. The constructed process may be in one or more parts that are bonded together. In another embodiment, the plastic building block is constructed via 3D printing. In some embodiments, a combination of techniques may be used. For example, the shell or outer surface area of the building block may be made via a mold, wherein the remaining area can be filled with melted plastic, which when cooled is configured to form the plastic building block described herein. Preferably, the plastic building block is formed of dense plastic with minimal hollow spaces as needed, such as the locking channels and the conduit, allowing the block to provide a sturdy building base having effective insulation properties. In some embodiments, filling material, such as sand may be used to fill in the hollow areas of the plastic building block. This can help make the wall more stable while providing an increase of insulation.

Incorporating recycled plastic into the fabrication of building materials, exemplified by the innovative plastic building blocks outlined in by the present invention, confers substantial environmental and functional benefits. This notably mitigates the environmental footprint by repurposing plastic waste, effectively diverting substantial volumes from landfills and marine environments, thus addressing a critical ecological challenge. The reuse of plastic material not only conserves natural resources but also decreases the necessity for new plastic production, leading to a significant reduction in energy usage and the emission of greenhouse gasses during the manufacturing process. Furthermore, the application of recycled plastic enhances the durability and longevity of the building blocks, ensuring resistance against environmental elements such as moisture and decay, which underscores the dual advantage of sustainability coupled with superior material performance. Further, this enables these sustainable materials of the present invention to be used in developing nations offering them construction materials for building and houses at a lower cost than traditional building materials.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternative embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A plastic building block comprising:

a rectangular body with a top side, a bottom side, a left side, a right side, a front side, and a rear side, the rectangular body including a plurality of vertical ridges located on the left side, the right side, the front side and the rear side and extending continuously from the top side to the bottom side thereof;

a plurality of male positioning elements located at the top side and protruding from a top surface thereof, the male positioning elements configured to facilitate interlocking with an identical adjacent plastic building block stacked thereon;

at least one circular conduit integrated within and penetrating through a center of the block, the at least one conduit configured to receive electrical wires, plumbing, or other utilities;

a female recess element located at the bottom side defining a rectangular body inner wall extending upwardly from a perimeter of the bottom side, the rectangular body inner wall configured to snugly fit with the plurality of male positioning elements of the adjacent plastic building block, such that the plurality of male positioning elements abut the rectangular body inner wall, ensuring stable stacking and alignment of interconnected said blocks;

wherein the plurality of male positioning elements comprise L-shaped guide elements, T-shaped guide elements and a circular guide element, each said guide element projecting upwardly from the top surface of the top side of the rectangular body, the circular guide element defining a top end of and extending upwardly around the at least one conduit, the T-shaped guide elements being positioned around a perimeter of the circular guide element and the L-shaped guide elements being positioned proximate a perimeter of the top side of the rectangular body; and wherein the building block is composed entirely of plastic and the interconnected blocks are configured to form exterior and interior walls of a building structure for human occupancy.

2. The plastic building block of claim 1, wherein the rectangular body is substantially hollow.

3. The plastic building block of claim 1, wherein the plastic building block is made from recycled plastic.

4. The plastic building block of claim 1, further comprising additional conduits of smaller size relative to the at least one conduit, wherein the additional conduits are configured for electrical, data, phone wires, or similar utilities.

5. The plastic building block of claim 1, wherein the plurality of male positioning elements extend approximately 5% of a total height of the plastic building block.

6. The plastic building block of claim 1, wherein the interconnected blocks are joined using bonding agents, epoxy, mortar, glue, or similar substances for permanent construction.

7. The plastic building block of claim 1, wherein the rectangular body is approximately 12 inches in length, 6 inches in height, and respective widths of either 12 inches or 6 inches.

8. The plastic building block of claim 1, wherein the rectangular body is square.

9. The plastic building block of claim 8, further comprising a second recess positioned on a respective said side of the plastic building block.

10. The plastic building block of claim 9, wherein the second recess is configured for use as an electrical box for electrical wiring or as a cutout for plumbing and other utilities.

11. The plastic building block of claim 1, wherein the rectangular body is divided into two identical sections that combine to form a unitary structure.

12. The plastic building block of claim 11, wherein the plurality of male positioning elements border each section of the two identical sections.

13. The plastic building block of claim 11, wherein the at least one conduit is two circular conduits, each circular conduit positioned at a center of each identical section.

14. The plastic building block of claim 13, wherein the L-shaped guide elements are positioned proximate to a border of each section of the two identical sections.

* * * * *